United States Patent [19]

Schmidt et al.

[11] 4,278,537

[45] Jul. 14, 1981

[54] APPARATUS FOR SEPARATING HEAVY SOLIDS AND LIGHT SOLIDS FROM A MIXTURE THEREOF

[75] Inventors: Uwe Schmidt, Stadtbergen; Dieter Schneider, Augsburg, both of Fed. Rep. of Germany

[73] Assignee: Alpine Aktiengesellschaft, Augsberg, Fed. Rep. of Germany

[21] Appl. No.: 24,242

[22] Filed: Mar. 27, 1979

[51] Int. Cl.[3] ..... B07B 1/36

[52] U.S. Cl. ..... 209/469; 209/486; 209/493

[58] Field of Search ..... 209/44, 466, 467, 480, 209/493, 494, 20, 26, 27, 468, 469

[56] References Cited

U.S. PATENT DOCUMENTS

| | | | |
|---|---|---|---|
| 1,262,554 | 4/1918 | Patterson | 209/480 |
| 1,875,296 | 8/1932 | Friend | 209/468 |
| 2,040,196 | 5/1936 | Berrisford | 209/467 |
| 2,063,533 | 12/1936 | Vissac | 209/466 X |
| 2,427,423 | 9/1947 | Shawcross | 209/467 |
| 2,513,603 | 7/1950 | Utley | 209/466 |

*Primary Examiner*—Ralph J. Hill
*Attorney, Agent, or Firm*—Pennie & Edmonds

[57] ABSTRACT

An apparatus for separating a mixture of heavy particulate material and light particulate material into separate fractions of heavy and light material is disclosed. The mixture is introduced to a first separating means, particularly an air jig, with a vibratory carrier for separating the mixture into a clean light fraction and a heavy fraction, which heavy fraction contains some light material. The heavy fraction is passed to a second separating means, this second separating means being a pneumatic table associated with the vibratory carrier for separating the said heavy fraction into a clean fraction of heavier particles and a mixture of lighter particles with some small heavier particles, which mixture is directed to a conveyor for recycling through the air jig. The apparatus provides for a very clean separation of heavy particulate material and light particulate material at a high throughput rate.

6 Claims, 5 Drawing Figures

APPARATUS FOR SEPARATING HEAVY SOLIDS AND LIGHT SOLIDS FROM A MIXTURE THEREOF

DESCRIPTION

BACKGROUND OF THE INVENTION

This invention relates to the separation of mixtures of solids according to the density of the solid components, particularly where the proportion of heavy solids to the total amount of solids is relatively small. It particularly relates to apparatus for separating heavy solids and light solids from mixtures thereof, which apparatus includes an air jig with a driven vibrating or "jigged" carrier and a means for separating the heavy fraction from the air jig which is contaminated with some light material, into a clean heavy fraction and a light fraction according to density.

PRIOR ART

Such devices are known as shown, for example, in German Pat. No. 623,320 of Nov. 28, 1935. In that patent, the means for separating the heavy fraction comprises a current of air blowing transverse to the material to be separated as it free falls through the air current. The lighter particles are carried the greatest distance by the air current, while the relatively heavier particles fall out closer to the air current. One disadvantage of this apparatus is that while it is intended to separate according to density, it can do so successfully only if the heavy and the light material have substantially the same particle size and shape. In many, perhaps most, cases, these prerequisites do not exist since each component of the mixture has a more or less wide particle size variation and different particle shapes. Accordingly, a clear separation of heavy solids material from light solids material is not possible under these conditions. In order to obtain a clear separation, additional devices are required, thus increasing the cost.

Still another device is shown in German published patent application P 27 01 345.2-24. The apparatus disclosed in this application comprises an air jig having a roll-off separator in the form of an inclined conveyor belt. The disadvantage with this device is that the shape of the particle becomes the essential separation criterion rather than density and, as such, there are a limited number of applications for the device. This device, for example, works best with solid particle mixtures where the heavy material has a round form and the relatively lighter material a flat form, such as the chips used for manufacture of chip boards which may be mixed with sand and rocks. There is also difficulty with this apparatus in that despite careful lateral covering of the conveyor belt and even the provision of a cleaning device on the top surface of the bottom run thereof, some of the material being worked upon works its way between the belt and the bottom guide or the bottom roller (usually the driving roller) thus jamming the belt.

SUMMARY OF THE INVENTION

The present device is, therefore, directed to overcoming these technical difficulties by providing a separating apparatus for separating heavy particulate material from light particulate material in a mixture thereof where the heavy material is initially a relatively small portion of the mixture. The apparatus comprises an air jig with a driven vibrating or jigged material carrier and a means for separating the heavy fraction from the air jig according to density in such a way that the device is trouble free, costs are reduced and there is achieved an improved separation of the heavy from the light material. Furthermore, this separation is achieved independently of the shapes of the particles.

To solve this problem, the present invention provides a pneumatic table to which the heavy fraction from the air jig is directed for further separation according to density. By the cooperation of the air jig and the pneumatic table, the characteristics of the two units complement each other so well that even a very small portion of heavy material may be suitably separated and high throughputs achieved with the air jig. The air jig itself provides a clean light fraction and the heavy fraction is charged to the pneumatic table, which then provides for a very clean separation of the heavy material from the remaining light material. The light material from the pneumatic table is then again charged to the air jig.

The throughput capacity of the pneumatic table itself is low since its operating principle is such as to operate upon a single layer of grains or particles. However, it can be so adjusted as to be adapted optimally to the heavy material fraction from the air jig which fraction is small in amount so that large total throughputs with a very clean separation of heavy material from light material can be obtained. Still further, relatively small heavy particles that are included in the charge to the pneumatic table from the air jig and which are mixed with light material will, because of their small particle size, be pushed together into a high concentration on the pneumatic table into a loose heap which then behaves as if the particles were somewhat larger so that this loose heap or compact mass when recycled to the air jig is discharged together with the larger particle heavy material. This effect can be utilized advantageously if, as described above, the light material discharged from the pneumatic table which still contains some heavy material is charged again onto the air jig, thus leading to a concentration of heavy particles in the heavy fraction of the air jig, and enhancing the described agglomeration effect.

Advantageously from the standpoint of cost and space requirements, the pneumatic table may be connected to the vibrating carrier of the air jig so that a separate drive and foundation are not required. It has been found that there is a sufficiently wide range of vibrating parameters with which the air jig and the pneumatic table can operate quite well simultaneously.

BRIEF DESCRIPTION OF THE DRAWINGS

The construction and operation of the device will be apparent to those skilled in the art from the following description and the accompanying drawings, in which.

DETAILED DESCRIPTION OF THE PREFERRED EMBODIMENT

Figure 1:
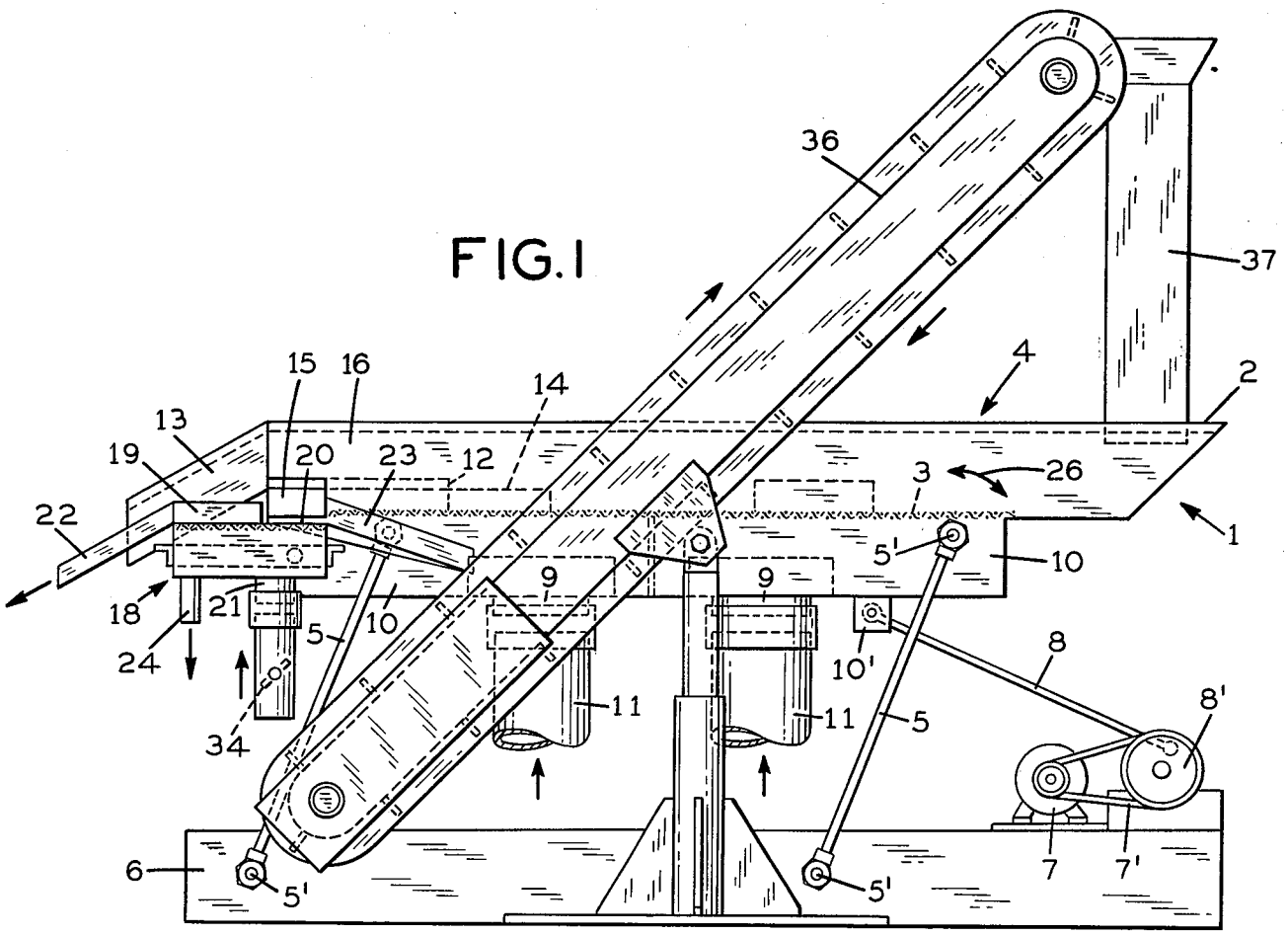
FIG. 1 shows a side elevation of the apparatus.

The mixture of solid particles to be separated, which comprises a light particulate material with which a relatively smaller portion of heavy particulate material is mixed, is fed to the air jig 1 at charging station 2 from whence it is fed by the vibration of the carrier 4 onto the screen bottom 3 of the carrier 4. Jigged material carrier 4 is a vibrating conveyor supported by rods 5 pivoted at one end to the base 6 and at their other end pivoted to the sides of air boxes 10 which, in turn, are secured to the carrier 4 below the screen 3. The ends of the rods 5 may be mounted by shock absorbing rubber bushings (not detailed) to suitable stub shafts 5'. Also secured to the base 6 is a driving motor 7 connected by belt 7' to an eccentric 8' which has pivoted thereto and eccentric of its axis a connecting rod 8 which is pivoted at its other end to a depending structural element 10' depending from and secured to one of the air boxes 10.

Air for separation of particulate material in accordance with known principles of air jigs (hereinafter called jigging air) is supplied intermittently through lines 11 connected by two connectors 9 to the air boxes 10. When the motor 7 is operated and the air is supplied intermittently as mentioned above, the material carrier 4 moves in a slight arc back and forth, as indicated by the arrow 26, which motion together with the jigging air results in a sinking of the heavy material with the light material arranged in a top layer over the heavy material which, in turn, rests upon screen bottom 3. This top layer of light material is moved by the vibrating of the carrier 4 toward and over the weir 12 and then onto the discharge chute 13.

The heavy fraction of the particulate material is directed by a guide bar 14, which is of lesser height than the weir 12. The guide bar 14 is on screen bottom 3 and directs or deflects the heavy fraction to a discharge opening 15 in the side wall 16 of the material carrier 4. This is accomplished by the oblique position of the guide bar 14. The heavy fraction which contains some light material thus passes through the opening 15, down the chute 17 and onto the top plate 20 of the pneumatic table 18.

Figure 2:
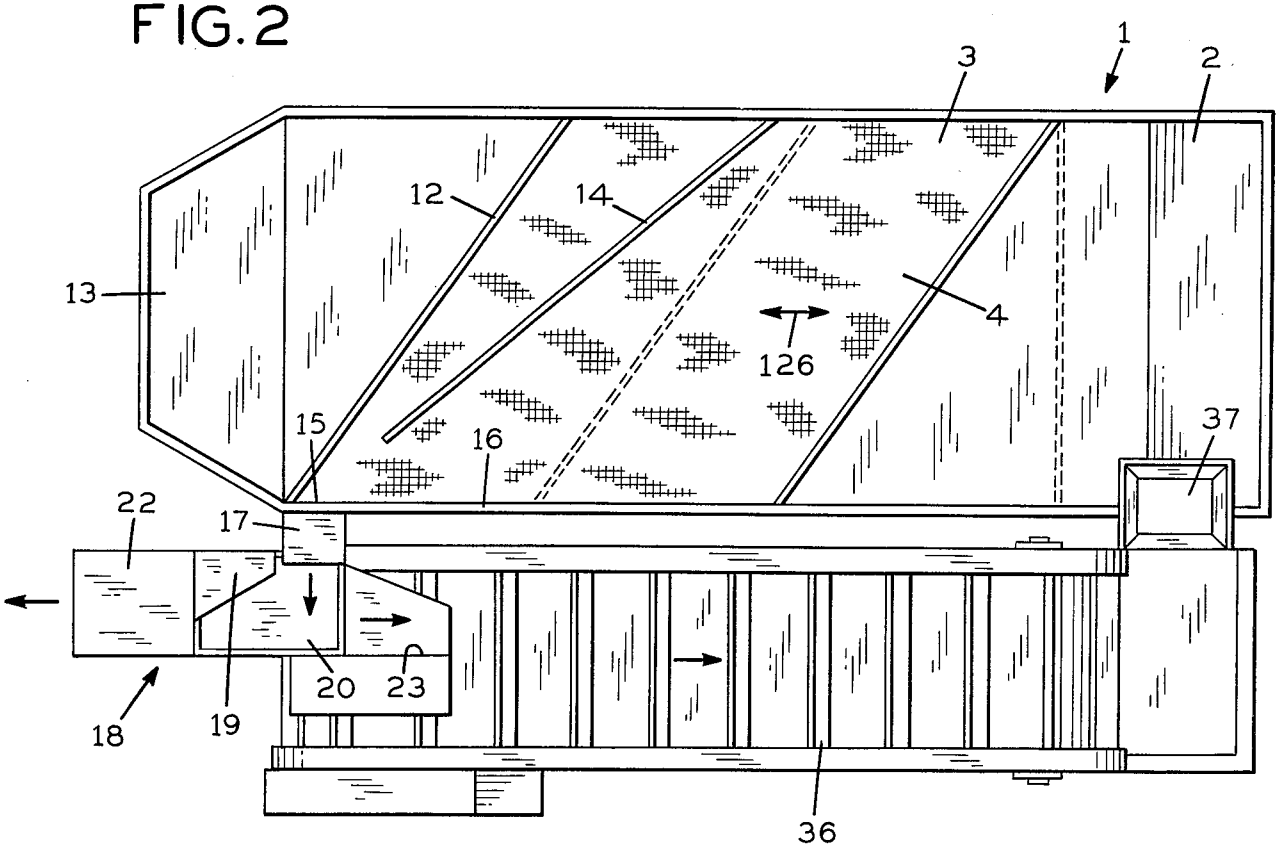
FIG. 2 shows a plan view of the apparatus.
Figure 4:
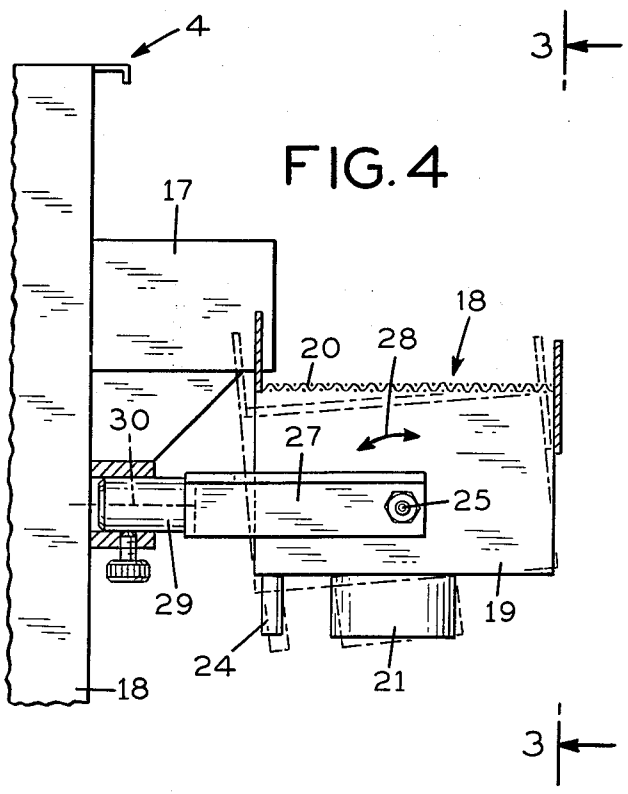
FIG. 4 shows an end elevation of the pneumatic table generally in the scale of FIG. 3 taken looking from left to right in FIG. 1.

This pneumatic table 18 is secured laterally on the jigged material carrier 4 and comprises a square box 19 with the plate 20 secured to the top thereof. Conduit 21 connects to the box 19 to provide a supply of working air. A chute 22 discharges clean heavy material and a discharge pipe 24 is provided for the discharge of material falling through the top plate 20. The longitudinal axis 25 of the pneumatic table extends parallel to the general direction of movement, indicated by the arrow 126 in FIG. 2, of the jigged material carrier 4. The pneumatic table 18 is secured in a generally U-shaped mount 27 and may be adjusted about its longitudinal axis 25, in order to influence the distribution of the material over the width of the top plate 20. The mounting of the pneumatic table 18 to the U-shaped mount 27 may be accomplished in any of a number of conventional ways, it being only necessary that the mounting provide for adjustability of the pneumatic table, as indicated by the arrows 28, about the axis 25. One such mounting arrangement is shown as comprising threaded studs 25' secured to the opposite walls of the box 19 and passing through one of the flanges of the angle irons which make up the U-shaped frame 27. Nuts 26' may then be threaded upon the threaded studs 25' and tightened to secure the pneumatic table 18 in its desired position about the axis 25. For additional securement, second nuts, like nuts 26', may be threaded upon the studs 25' as lock nuts. As mentioned, other arrangements for securing the table 18 in an adjustable manner about the axis 25 are contemplated. The solid line and dashed line positions, shown in FIG. 4, indicate but two of the possible adjusted positions for the table 18.

Figure 3:
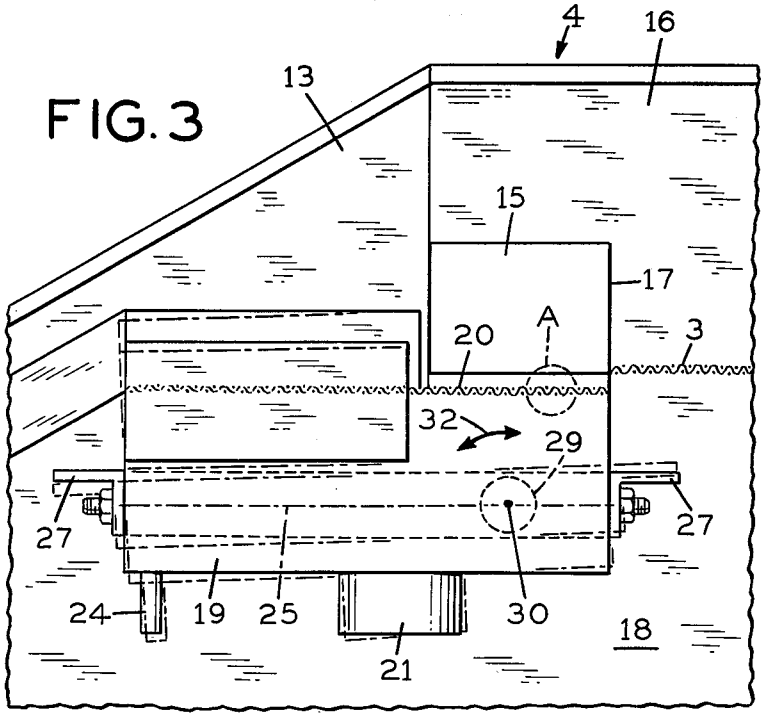
FIG. 3 shows an enlarged view of the pneumatic table in elevation in accordance with FIG. 1.

A laterally extending stub shaft 29 is secured to the U-shaped frame 27, by welding or the like, and is arranged with its axis 30 perpendicular to the longitudinal axis 25. The stub shaft 29 is received within a bushing 31 rigidly connected, by welding or the like, to the carrier 4. The stub shaft 29 is secured within the bushing 31 by any suitable means, such as the set screw 31' which is threadedly engaged in a threaded opening in the bushing 31 and bears against the stub shaft 29. A knurled head on the set screw 31' permits hand-tightening of the set screw 31', although the same may be tightened by wrench or some other tool, if desired. Other means of securing the stub shaft 29 within the bushing 31 after adjustment about the axis 30 are contemplated, and any number of conventional securements, will be apparent to those skilled in the art. In FIG. 3, the solid line and dashed line positions are but two of the possible positions for adjustment of the pneumatic table 18 about the axis 30.

Figure 5:
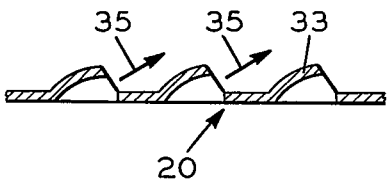
FIG. 5 shows a further enlarged cross-section through the top plate of the pneumatic table in the area of the circle A of FIG. 3.

The top plate 20 comprises a commercially available ribbed trapezoidal screen which has in its cross-section the form shown in FIG. 5. Air supplied through the conduit 21 may be adjusted by the throttle valve 34 and after passing through the box 19 it issues through the top plate 20 in the direction indicated by the arrows 35 in FIG. 5. That is to say, it is directed upwardly and toward the rear of the apparatus (toward the right in the figures). The special shape and arrangement of the openings in the top plate 20, as shown in FIG. 5, insures that the air travels in the direction indicated by the arrow 35 which is generally in the opposite direction to the direction in which the heavy material fraction is being conveyed by the effects of the vibrating carrier 4. The openings in the top plate 20 are caused by up-struck ribs 33. The fractions of heavy and light material separated on the pneumatic table 18 are conveyed in opposite directions. The heavy material is discharged through chute 22 and removed for further use, which removal may be effected by any suitable means, such as a conveyor not shown.

Small heavy material portions which may have dropped through the openings in the top plate 20 are discharged pneumatically with a part of the working air through the discharge pipe 24. The cross-sectional area of the discharge pipe 24 is so selected or adjusted that the discharged particles have only a very low velocity and thus may be trapped in a simple open container or, if desired, fed to the rest of the heavy material issuing from the chute 22.

The light material separated by the pneumatic table 18, which may still contain small portions of heavy material, and, in particular, small sized heavy particles, is moved by the air issuing through the plate 20 and in part by the vibration of the table 18 toward the chute 23 which discharges this fraction onto the inclined conveyor belt 36, which then moves it upwardly and charges it to the air jig, again over the chute 37.

It will be seen that by use of the apparatus described above, relatively high throughputs may be achieved for the air jig or vibrating carrier 1 with the clean light (and larger quantity) fraction being discharged over the chute 13. The smaller quantity of heavy fraction which may have some light material mixed therewith is then separated on the pneumatic table resulting in a clean heavy fraction being discharged from the chute 22. The light material, which may still have some heavy material mixed therewith, is then recycled.

It will also be seen that by securing the pneumatic table 18 to the carrier 4 that certain advantages are achieved in that a separate drive is not required nor is a special or separate feeding device necessary for feeding the material to the pneumatic table. Also, the adjustments provided for the pneumatic table permit adjustment of the same in order to achieve the optimum separation for a variety of different particulate material mixtures.

While the openings produced by the ribs 33 in the plate 20 guide the air in the direction of the arrows 35 in the preferred arrangement, it is possible to utilize the plate 20 and the pneumatic table 18 with the air issuing vertically upwardly perpendicular to the plate 20. Also, it is possible to vary the size of the openings in the top plate 20, since there are a variety of sizes available commercially in these ribbed trapezoidal screens. Alternatively, for certain applications, it may be desired to have several hole widths in the same plate.

By proper adjustment of the working air through the throttle 34 a sifting effect may be achieved which is very effective for separating according to density. As indicated above, this is generally adjusted so that part of the heavy particles are carried along with the light material for recycling, thus resulting in a very clean heavy fraction. The heavy material returned with the light material to the air jig enhances the previously mentioned agglomeration effect of the small heavy particles on the pneumatic table.

If desired or necessary, a suction hood may be positioned above the pneumatic table for dust removal.

I claim:

1. In an apparatus for separating a mixture of heavy particulate material and light particulate material into separate fractions of heavy and light material comprising first and second separating means, said first separating means being an elongated air jig, means for vibrating the air jig, and means for discharging the clean light fraction of material from one end of said air jig, the improvement comprising:

(a) lateral discharge means for discharging the heavy fraction (which heavy fraction still contains some light material) from the air jig laterally thereof;

(b) said second separating means being positioned laterally of said air jig to receive the heavy fraction containing some light material discharged from the air jig by said lateral discharge means;

(c) said second separating means being a pneumatic table having a top plate onto which said heavy fraction is discharged, said pneumatic table being capable of separating said heavy fraction into clean heavy particles and lighter particles due to the different densities;

(d) said pneumatic table being mounted to said air jig for a vibratory conveying action for conveying the heavy particles of said heavy fraction received from the air jig toward one end of said pneumatic table to provide a clean heavy particulate fraction;

(e) means for providing an air stream in a direction generally opposite to the direction of movement of the clean heavy particles on said pneumatic table which air stream conveys the lighter particles of said heavy fraction in said opposite direction; and (f) means for recycling the lighter particles of said heavy fraction from said pneumatic table back to said air jig.

2. The apparatus according to claim 1, in which said pneumatic table is rigidly connected with the vibrating carrier of the air jig.

3. The apparatus according to claim 2, in which said pneumatic table is mounted for pivotal adjustment about its longitudinal axis.

4. The apparatus according to claim 3, in which said pneumatic table is mounted for pivotal adjustment about an axis transverse to its longitudinal axis.

5. The apparatus according to claim 4, in which the top plate of said pneumatic table has openings which deflect the working air of said table in a direction generally opposite to that of the discharge of the clean heavy fraction.

6. The apparatus according to any one of claims 1, 2, 3, 4 or 5, in which said pneumatic table includes a discharge means for discharging heavy material falling through the top plate.

* * * * *